US009734808B2

(12) United States Patent
Keller et al.

(10) Patent No.: US 9,734,808 B2
(45) Date of Patent: Aug. 15, 2017

(54) OUTDOOR MUSICAL DRUM STRUCTURES

(71) Applicant: Landscape Structures Inc., Delano, MN (US)

(72) Inventors: Thomas L. Keller, Delano, MN (US); Garry Jones, Kilkenny (IE)

(73) Assignee: Landscape Structures, Inc., Delano, MN (US)

( * ) Notice: Subject to any disclaimer, the term of this patent is extended or adjusted under 35 U.S.C. 154(b) by 0 days.

(21) Appl. No.: 15/292,274

(22) Filed: Oct. 13, 2016

(65) Prior Publication Data

US 2017/0110099 A1 Apr. 20, 2017

Related U.S. Application Data

(60) Provisional application No. 62/241,978, filed on Oct. 15, 2015.

(51) Int. Cl.

| | |
|---|---|
| ***G10D 13/02*** | (2006.01) |
| ***G10D 13/08*** | (2006.01) |
| ***G10G 5/00*** | (2006.01) |

(52) U.S. Cl.

CPC ..... *G10D 13/08* (2013.01); *G10D 13/026* (2013.01); *G10D 13/027* (2013.01); *G10D 13/028* (2013.01); *G10G 5/005* (2013.01)

(58) Field of Classification Search

CPC ... G10D 13/026; G10D 13/027; G10D 13/028
USPC ..... 84/414
See application file for complete search history.

(56) References Cited

U.S. PATENT DOCUMENTS

| | | | | |
|---|---|---|---|---|
| 4,469,003 A | | 9/1984 | Phelps | |
| 4,796,009 A | * | 1/1989 | Biersach | G10K 11/025 181/144 |
| 4,890,786 A | * | 1/1990 | Oberhofer | B65D 3/30 229/5.5 |

(Continued)

FOREIGN PATENT DOCUMENTS

| | | | | |
|---|---|---|---|---|
| GB | 2478324 A | * | 9/2011 | G10K 1/26 |
| JP | 05-075793 U | | 10/1993 | |
| KR | 10-1506882 B1 | | 3/2015 | |

OTHER PUBLICATIONS

"Fun and Colourful Conga Outdoor Drum—Playground Drums," Web page <http://percussionplay.com/congas/>, 1 page, Mar. 30, 2015, retrieved from Internet Archive Wayback Machine <https://web.archive.org/web/20150330154835/http://percussionplay.com/congas/> on Apr. 2, 2017.*

(Continued)

*Primary Examiner* — David Warren
*Assistant Examiner* — Christina Schreiber
(74) *Attorney, Agent, or Firm* — Kelly, Holt & Christenson, PLLC; Katherine M. Scholz

(57) ABSTRACT

A drum configured for permanent installation in an outdoor environment is presented. The drum comprises a mounting structure configured to permanently engage a mounting surface in the outdoor environment. The drum also comprises a shell coupled to the mounting structure. The drum also comprises a drum head coupled to the shell through use of a plurality of fasteners. The drum head comprises a tuned configuration. The drum structure is configured to be weather resistant. The drum head is configured to maintain the tuning configuration after a period of outdoor exposure.

19 Claims, 9 Drawing Sheets

(56) References Cited

U.S. PATENT DOCUMENTS

| | | | | |
|---|---|---|---|---|
| 5,266,732 | A * | 11/1993 | Suzuki | G10F 1/10 84/103 |
| 5,345,852 | A | 9/1994 | Takahashi et al. | |
| 6,150,594 | A * | 11/2000 | Fiondella | G10D 13/029 84/411 R |
| 6,517,467 | B1 * | 2/2003 | Sutton | A63G 21/00 482/35 |
| 6,551,167 | B1 * | 4/2003 | Duck | A63H 5/00 446/214 |
| 7,534,949 | B1 * | 5/2009 | Estes | G10D 13/08 446/416 |
| 8,647,165 | B1 * | 2/2014 | Blackwood | A63H 33/006 446/105 |
| 8,936,502 | B2 * | 1/2015 | King | A63H 33/00 446/227 |
| 2003/0047059 | A1 | 3/2003 | Brown, Jr. | |
| 2003/0126971 | A1 * | 7/2003 | Rawlins | G10D 13/04 84/419 |
| 2004/0035742 | A1 * | 2/2004 | Aesch | G10G 7/00 206/571 |
| 2006/0000340 | A1 | 1/2006 | Barakat | |
| 2006/0236843 | A1 | 10/2006 | Becker-Ehmck | |
| 2006/0272478 | A1 * | 12/2006 | Steinhour | B29C 44/12 84/452 P |
| 2009/0013850 | A1 | 1/2009 | Abe | |
| 2010/0150359 | A1 * | 6/2010 | KnicKrehm | G01H 7/00 381/58 |
| 2014/0026736 | A1 | 1/2014 | Sato et al. | |
| 2014/0060285 | A1 | 3/2014 | Bradfeild et al. | |
| 2015/0063621 | A1 * | 3/2015 | Lilley, Jr. | H04R 1/347 381/345 |
| 2015/0187344 | A1 * | 7/2015 | James | F21V 33/0056 84/411 R |
| 2017/0110099 | A1 * | 4/2017 | Keller | G10D 13/08 |
| 2017/0110100 | A1 * | 4/2017 | Keller | G10D 13/08 |

OTHER PUBLICATIONS

"Tuned Drum"—Freenotes Harmony Park Outdoor Musical Instruments, Web page <http://freenotesharmonypark.com/wp-content/uploads/2016/05/FHP-Tuned-Drums-Final.pdf>.*

Percussion Play, "Outdoor Musical Instruments" First accessed Dec. 2014. 3 Pages.

Acoustic Arts, "Playground Percussion 2013 Catalogue" Jun. 25, 2013. 8 Pages.

Sound Play, "Accessible Musical Playground Equipment," http://www.soundplay.com/metallophones.html. Mar. 9, 2010. 1 Page.

Freenotes, "Outdoor Musical Instruments 2015 Product Catalog," Jan. 1, 2015. 15 pages.

Grounds for Play, "Music Curricula—Outdoor music instruments for your commercial playground", http://www.groundsforplay.com, Feb. 2, 2011, 3 pages.

Prosecution History for U.S. Appl. No. 15/290,559, including: Non-Final Office Action dated Dec. 20, 2016, and Application and Drawings, filed Oct. 11, 2016, 52 pages.

International Search Report and Written Opinion for International Patent Application No. PCT/US2016/056741, dated Dec. 14, 2016, date of filing: Oct. 13, 2016, 17 pages.

International Search Report and Written Opinion for International Patent Application No. PCT/US2016/056735, dated Dec. 14, 2016, date of filing: Oct. 13, 2016, 15 pages.

* cited by examiner

OUTDOOR MUSICAL DRUM STRUCTURES

CROSS-REFERENCE TO RELATED APPLICATIONS

The present application is based on and claims the benefit of U.S. Provisional Patent Application Ser. No. 62/241,978 filed Oct. 15, 2015, the content of which is hereby incorporated by reference in its entirety.

BACKGROUND

Research has found that learning and playing music facilitates learning other subjects and enhances skills that children inevitably use in other areas. Childhood is the time when children learn about their world, primarily through play. If a play environment contains sufficiently rich musical elements, there will be a continuous exposure to new musical elements followed by the child's playful experimentation and learning.

SUMMARY

A drum configured for permanent installation in an outdoor environment is presented. The drum comprises a mounting structure configured to permanently engage a mounting surface in the outdoor environment. The drum also comprises a shell coupled to the mounting structure. The drum also comprises a drum head coupled to the shell through use of a plurality of fasteners. The drum head comprises a tuned configuration. The drum structure is configured to be weather resistant. The drum head is configured to maintain the tuned configuration after a period of outdoor exposure.

DETAILED DESCRIPTION OF ILLUSTRATIVE EMBODIMENTS

The present disclosure relates to embodiments of outdoor drum installations that are configured to be sustainable, durable and allow a user to produce robust and true sound.

Musical instruments can produce sound through a variety of mechanisms, depending on the type of instrument and sound desired. For example, drums, guitars, and trumpets all allow a user to produce sound through different mechanisms. However, many instruments are not easily optimized for prolonged use in an outdoor recreational environment. In addition, instruments that are designed for sustainability often lack the configuration and proper composition that allow the user to produce robust sound. One solution is to create outdoor musical instrument structures optimized for outdoor recreation areas, such as playgrounds and parks, without inhibiting a user's ability to produce robust sound. Another important consideration for outdoor musical instrument structures is the ability for all interested users to engage the structures. For example, at least some embodiments described herein may be configured to allow for play by users of all heights and abilities. For example, in some embodiments, the instruments are configured to allow for increased accessibility for users in a wheelchair.

Providing an outdoor musical instrument presents many logistical challenges. The outdoor environment presents temperatures at both hot and cold extremes. Further, an outdoor musical instrument is also exposed to weather—wind, rain and particulates. Additionally, maintaining consistent tuning is also a problem, as outdoor areas are designed for infrequent, or no regular maintenance. Also, there are theft prevention concerns, requiring that no part of the instrument be easily removed, but without inhibiting use. For at least these reasons, musical instruments require significant design for permanent installation and use in an outdoor environment, and cannot merely be transferred from an indoor environment to an outdoor environment Additionally, there are vandalism concerns. While indoor instruments are typically used under supervision, outdoor musical instruments may be used in areas with little or no supervision at all. Therefore, it is important that outdoor musical instruments be constructed to withstand vandalism.

Also a playground environment has unique considerations that other environments lack. Playgrounds have minimal supervision, whereas an indoor musical instrument is normally operated under supervision of a teacher and a child only uses it alone after professional training. Playgrounds ideally require infrequent (or no regular) repairs, whereas an indoor musical instrument is fragile and requires regular repair and cleaning. While some embodiments are described herein in the context of permanent installation within a playground environment, at least some embodiments are also suited for installation in other outdoor recreational areas, such as parks, for example.

Figure 1:
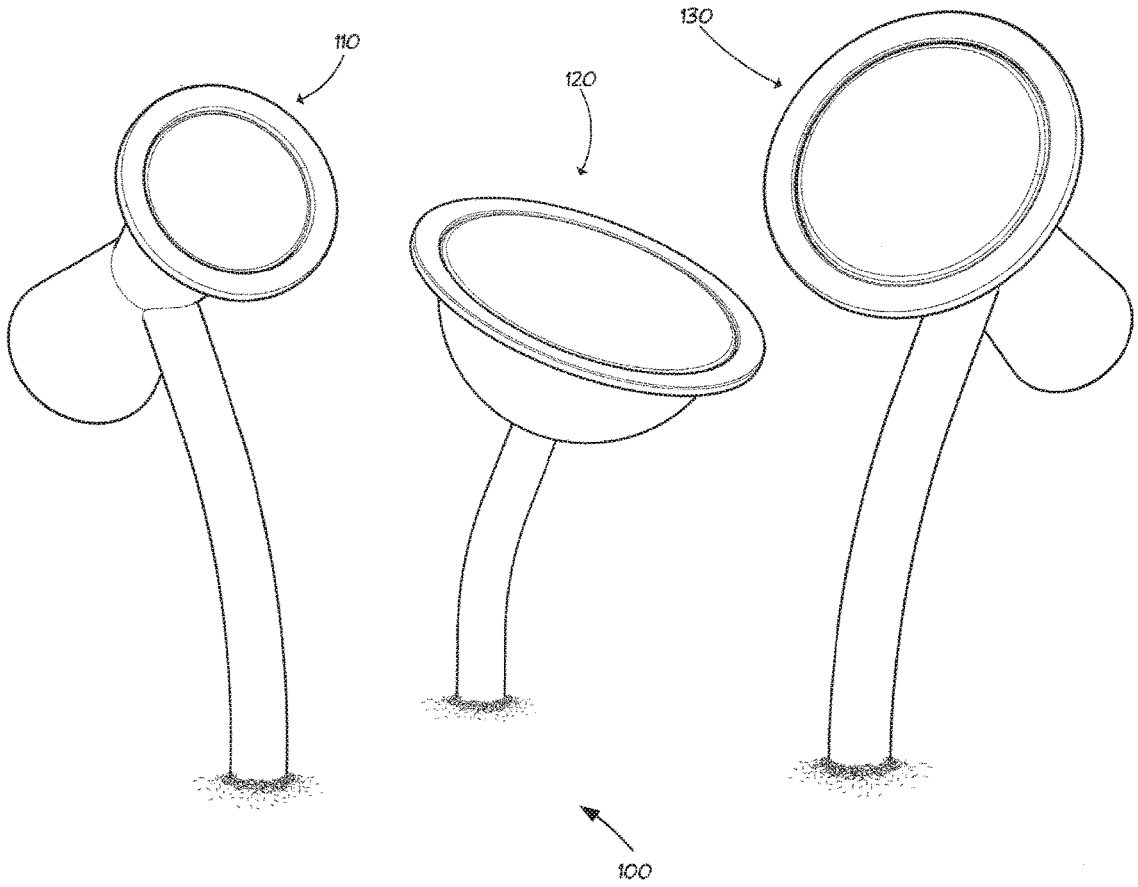
FIG. 1 illustrates a perspective view of a plurality of drums in accordance with one embodiment of the present invention.

FIG. 1 illustrates a perspective view of a plurality of drums in accordance with one embodiment of the present invention. Drum set 100, in the embodiment illustrated in FIG. 1, comprises a kundu drum 110, a kettle drum 120, and a goblet drum 130. In one embodiment, drum set 100 is arranged as shown in FIG. 1. In other embodiments, the drums 110, 120, and 130 could be arranged in any other configuration. In other embodiments, drum set 100 may include fewer or more drums, or different types of drums than those enumerated.

Figure 2:
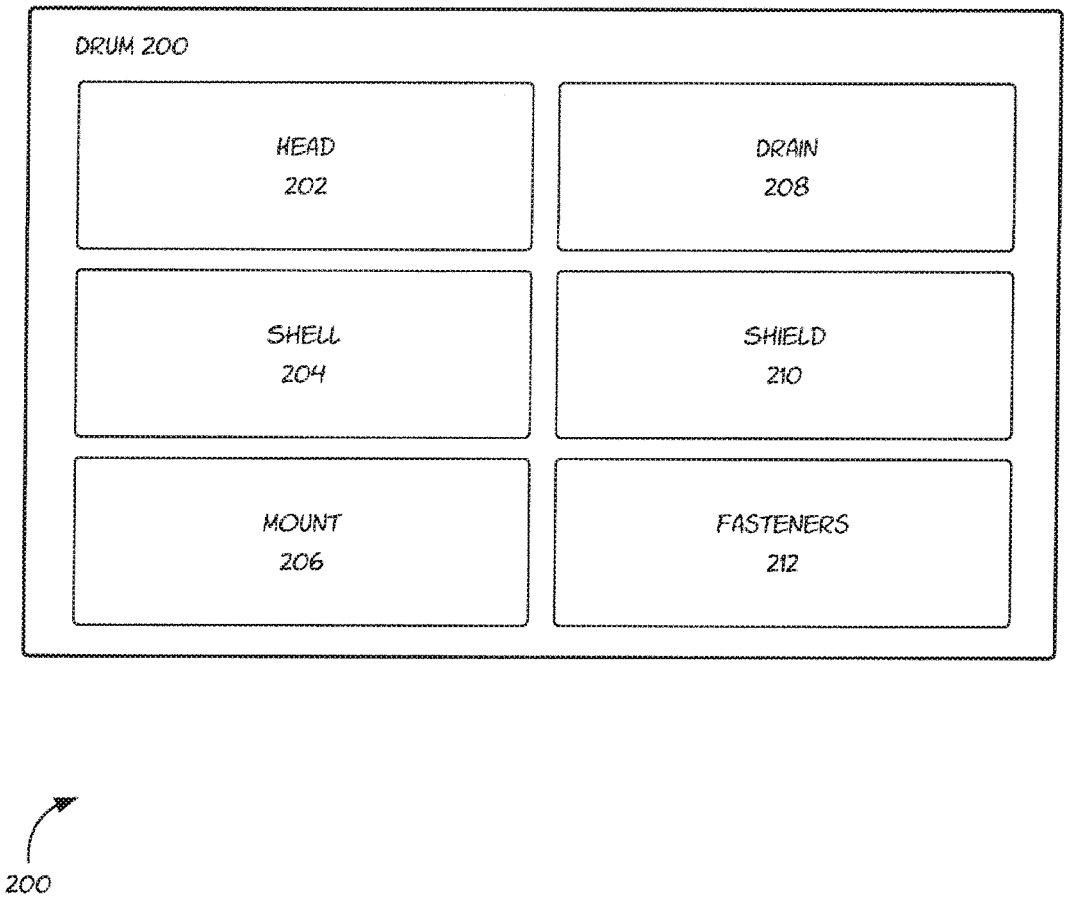
FIG. 2 illustrates a block diagram of an outdoor drum in accordance with one embodiment of the present invention.

FIG. 2 illustrates a block diagram of an outdoor drum in accordance with one embodiment of the present invention. Drum 200, in the embodiment illustrated in FIG. 2, comprises a drum head 202, a shell 204, a mount 206, a drain 208, a shield 210 and fasteners 212. In one embodiment, components of drum 200 are weather resistant. In one embodiment, the components of drum 200 are theft/vandalism resistant.

Drum head 202 is configured to create sound in conjunction with shell 204. Drum head 202, in one embodiment, comprises a weather resistant and strike-resistant material. In one embodiment, drum head 202 comprises a material configured to, once stretched to a desired tension, maintain a tensed position. Drum head 202 may also comprise a material that experiences little or no expansion/contraction in response to temperature changes, such that the sound produced does not change with changing seasonal temperatures. Drum head 202 must also comprise a durable material configured to resist cracking or breaking due to temperature changes and/or vandalism. In one embodiment, drum head 202 comprises plastic. In one embodiment, drum head comprises an Ultraviolet Light (UV) stabilized polycarbonate. A polycarbonate drum head 202 may, for example, produce a better sound quality than previous designs which have used polyethylene, LLDPE, or PVC, which produce a lower quality sound, for example a duller drum sound when struck. In another embodiment, drum head comprises ABS. However, drum head 202 can be made of any material that is weather resistant, requires little or no maintenance, and maintains the sound quality at installation, over its installed lifetime. For example, in one embodiment, drum head 202 is configured to maintain sound quality, such that a retuning step is not require after a year-long exposure period. In one embodiment, drum head 202 is configured such that sound quality is substantially the same after 5 years. In another embodiment, drum head 202 is configured such that sound quality is substantially the same after 10 years. In a further example, drum head 202 is configured such that sound quality is substantially the same after 15 years.

In one embodiment, shell 204 is configured to resonate the sound created by striking drum head 202. Shell 204 in one embodiment, has an open interior that may be shaped as desired to create different sounds. In one embodiment the shape of shell 204 is a semi sphere. In other embodiments the shape of shell 204 is a cylinder or other shapes suitable for a desired sound. The thickness of shell 204 may be selected to control the resonance and volume of the drum 200, for example, a thinner shell 204 will be louder and have more resonance than a thicker shell 204. The diameter of shell 204 may control the pitch of the drum 200, for example, a larger diameter will create a lower pitch. The diameter of shell 204 may also change the projection of drum 200, for example, a larger diameter will create more projection and a higher volume. A depth of shell 204 may also control the projection and volume of drum 200, for example, the greater the depth of shell 204, the quieter drum 200. In one embodiment, the shape of shell 204 is at least configured partially to allow for liquid drainage. Shell 204 can be made of various materials. In one embodiment, shell 204 is made out of a corrosion-resistant steel. In another embodiment, shell 204 is made out of aluminum.

Mount 206, in one embodiment, is configured to couple to, and support shell 204. Mount 206, in one embodiment, is configured to maintain an orientation of shell 204 and drum head 202 such that a user in a wheelchair can use the drum 200, e.g. at a certain height and angle. In one embodiment, mount 206 maintains a minimum knee clearance of 27," as recommended by the ADA (Americans with Disabilities Act), for sufficient accessibility by a user in a wheelchair. In one embodiment, mount 206 is configured to permanently couple to the ground. In one embodiment, mount 206 is a mounting mechanism configured to attach to another structure. Mount 206 is, in one embodiment, made out of a durable material. In one embodiment, mount 206 comprises steel. In one embodiment, mount 206 comprises aluminum. Other embodiments may envision using other materials.

In one embodiment, drum 200 comprises a drain 208. In one embodiment, drain 208 is a hole in a bottom of shell 204. In another embodiment, drain 208 is a component coupled to shell 204 configured to remove liquid. Drain 208 may serve several purposes such as draining any precipitation caught in shell 204, preventing animal inhabitation in shell 204 and allowing sound to escape shell 204. In one embodiment, drain 208 comprises a rust or corrosion-free material. In one embodiment, drain 208 comprises a plastic material. In another embodiment, drain 208 comprises stainless steel.

Shield 210 is coupled to shell 204 or to drum head 202, in one embodiment. Shield 210 may serve many purposes. Shield 210 may be configured, in one embodiment, to protect edges of shell 204 and drum head 202, as well as any fasteners 212. Shield 210 may also protect users from sharp edges or other surfaces that may pose a danger. Shield 210 may also be more aesthetically pleasing than the edges of shell 204, drum head 202, or fasteners 212. In one embodiment, shield 210 comprises plastic. In one embodiment, shield 210 comprises polyurethane. In another embodiment, shield 210 comprises foam. In another embodiment, shield 210 comprises metal. In one embodiment, shield 210 is coupled to shell 204 and/or drum head 202 through use of one or more fasteners 212. In one embodiment, fasteners 212 comprise a snap fitting.

Figure 3:
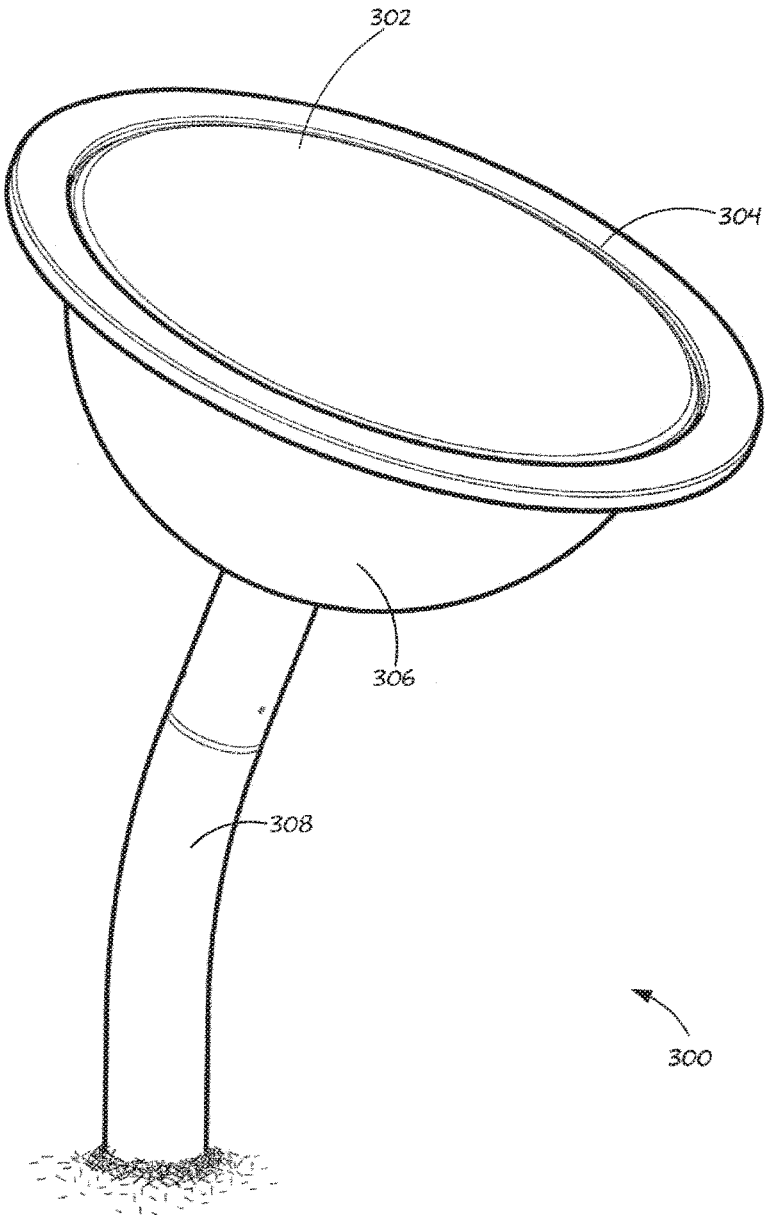
FIG. 3 illustrates an outdoor drum in accordance with one embodiment of the present invention.

FIG. 3 illustrates an outdoor drum in accordance with one embodiment of the present invention. Drum 300, in the embodiment illustrated in FIG. 3, comprises a head 302, a shield 304, a shell 306, and a base 308. Base 308, in one embodiment, is coupled to shell 306 and holds the drum 300 in a semi-permanent orientation, such that it can be moved by a professional installer, but not by a standard user. Base 308, in one embodiment, is attached semi-permanently to the ground or another mounting structure. Base 308, in one embodiment, is attached permanently to the ground or another mounting structure. In one embodiment, base 308 is attached to the ground through the use of a direct burial method. In another embodiment, base 308 is attached to the ground through the use of a flange and anchors in a surface mount to the ground. In another embodiment, base 308 is attached to a playground structure. In one embodiment, base 308 is metal. In one embodiment, base 308 comprises steel. In one embodiment, based 308 is plastic. In some embodiments, base 308 is comprises another weather resistant material.

Shell 306 may be coupled to base 308 through a variety of fastening mechanisms. In one embodiment, shell 306 is welded to base 308. In another embodiment, shell 306 is coupled to base 308 through the use of one or more fasteners. In another embodiment, shell 306 and base 308 are manufactured as one component. In one embodiment, shell 306 has an inner open space. The inner open space may increase the quality of sound produced. The open space within shell 306 may also cause many problems in an outdoor environment. The open space may gather rain water or be inhabited by animals, for example spiders, wasps, small mammals, etc. A small drain hole, in one embodiment, may be present on shell 306 to allow any collected precipitation to drain. But, in one embodiment, the hole is small enough to inhibit animals entering shell 306.

Shell 306, in one embodiment, is coupled to drum head 302. Drum head 302 and shell 306, in one embodiment, are the active components of drum 300 that generate sound. In one embodiment, drum head 302 is less than 30" wide. In one embodiment, drum head 302 is greater than 23" wide.

However, other appropriately sized shells can also be used, in other embodiments. An open space within shell 306 allows the sound generated by drum head 302 to resonate and create a more robust sound.

Drum head 302, in one embodiment, is configured for durability in an outdoor environment. In one embodiment, drum head 302 comprises polycarbonate. In other embodiments, drum head 302 comprises another weather resistant material. Drum head 302 is, in one embodiment, tensioned across, and coupled to, drum shell 306. In one embodiment, however, drum head 302 is tensioned on a rigid ring, which is coupled to shell 306. Often drum heads have weakened edges where they connect to their tensioning points. In an indoor environment, this is not generally an issue. Tensioning, in one embodiment, occurs during installation. In one embodiment, drum head 302 comprises a durable, weather proof material configured to maintain an installed sound after a period of outdoor exposure without the need for a retuning. For example, the drum head 302 may be configured, once tensioned, to maintain a tensioned position (and, therefore, produce substantially the same tuned sound) after an exposure period of one year, five years, ten years, fifteen years or longer.

However, in an outdoor environment, the delicate edges of a drum head may be more exposed to extreme conditions or at risk of damage by untrained, often younger, users. To protect against potential damage, a shield 304 can be attached to shell 306 or drum head 302. Shield 304, in one embodiment, is plastic. In another embodiment, shield 304 comprises metal. Material shield 304, in one embodiment, comprises a material selected based on a particular installation zone, safety concerns, strength, weather resistance, and aesthetics. In one embodiment, shield 304 is configured to maintain a tension on drum head 302.

Figure 4:
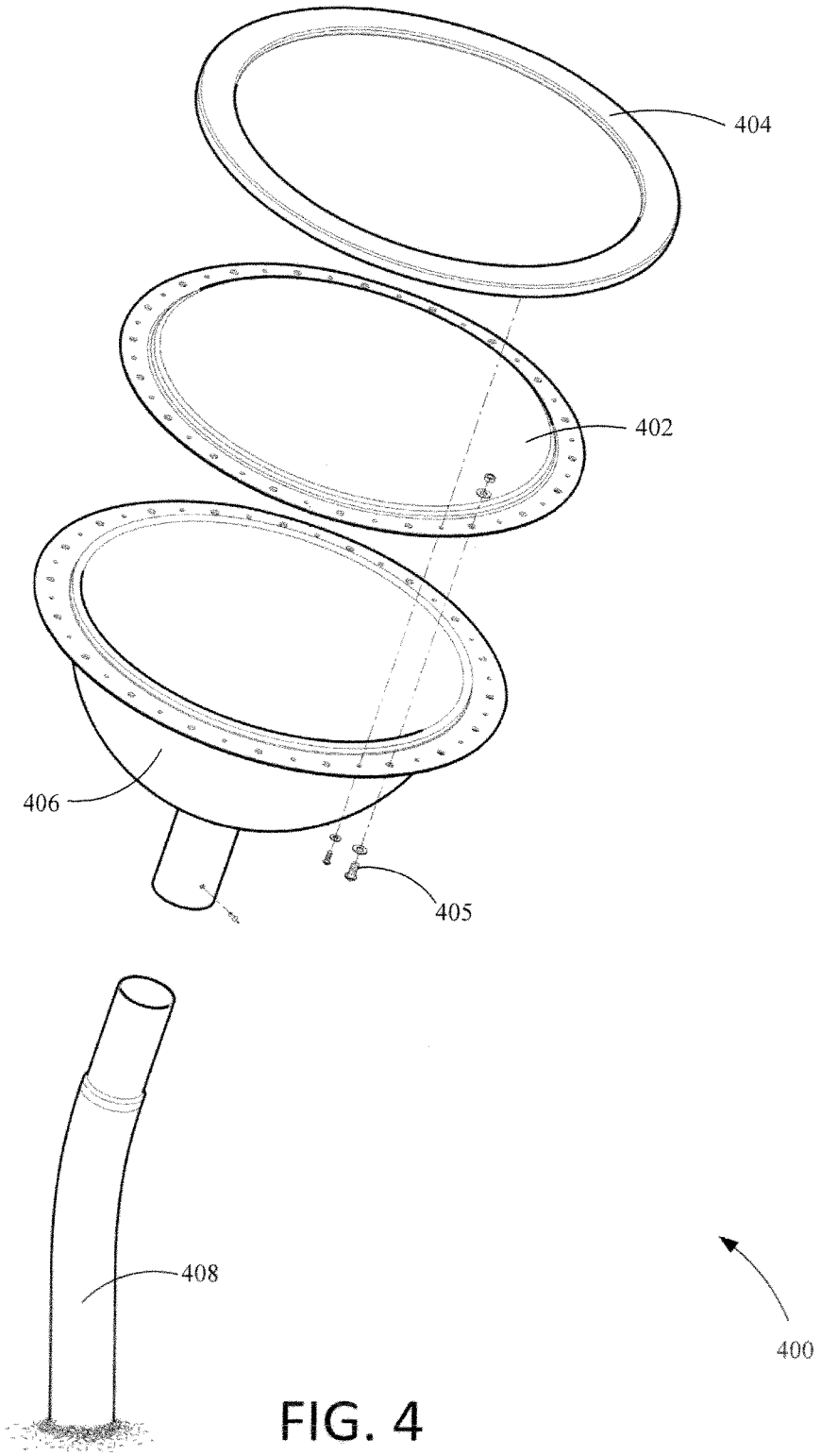
FIG. 4 illustrates an exploded view of an outdoor goblet drum in accordance with one embodiment of the present invention.

FIG. 4 illustrates an exploded view of an outdoor goblet drum in accordance with one embodiment of the present invention. The embodiment illustrated in FIG. 4, shows one possible assembly of a drum 400. In one embodiment, base 408 is permanently attached to the ground. In another embodiment, base 408 is attached to another structure. In the embodiment shown in FIG. 4, shell 406 is received by base 408, and is coupled to base 408 through use of a rivet. In another embodiment, shell 406 could be coupled to base 408 by welding. In other embodiments, shell 406 is coupled to base 408 through the use of other suitable fastening mechanisms. Drum head 402, in one embodiment, is coupled to shell 406 through the use of fasteners 405. In one embodiment, fasteners 405 provide a required tension across bead 402. In the embodiment of FIG. 4, head 402 is pre-tensioned onto an attachment point of a ring, such that it produces a desired installed sound. Fasteners 405, in one embodiment, also couple shield 404 to shell 406. In another embodiment, shield 404 snap fits onto shell 406. A snap fitting may also be configured to, in one embodiment, provide tension across head 402.

Figure 5:
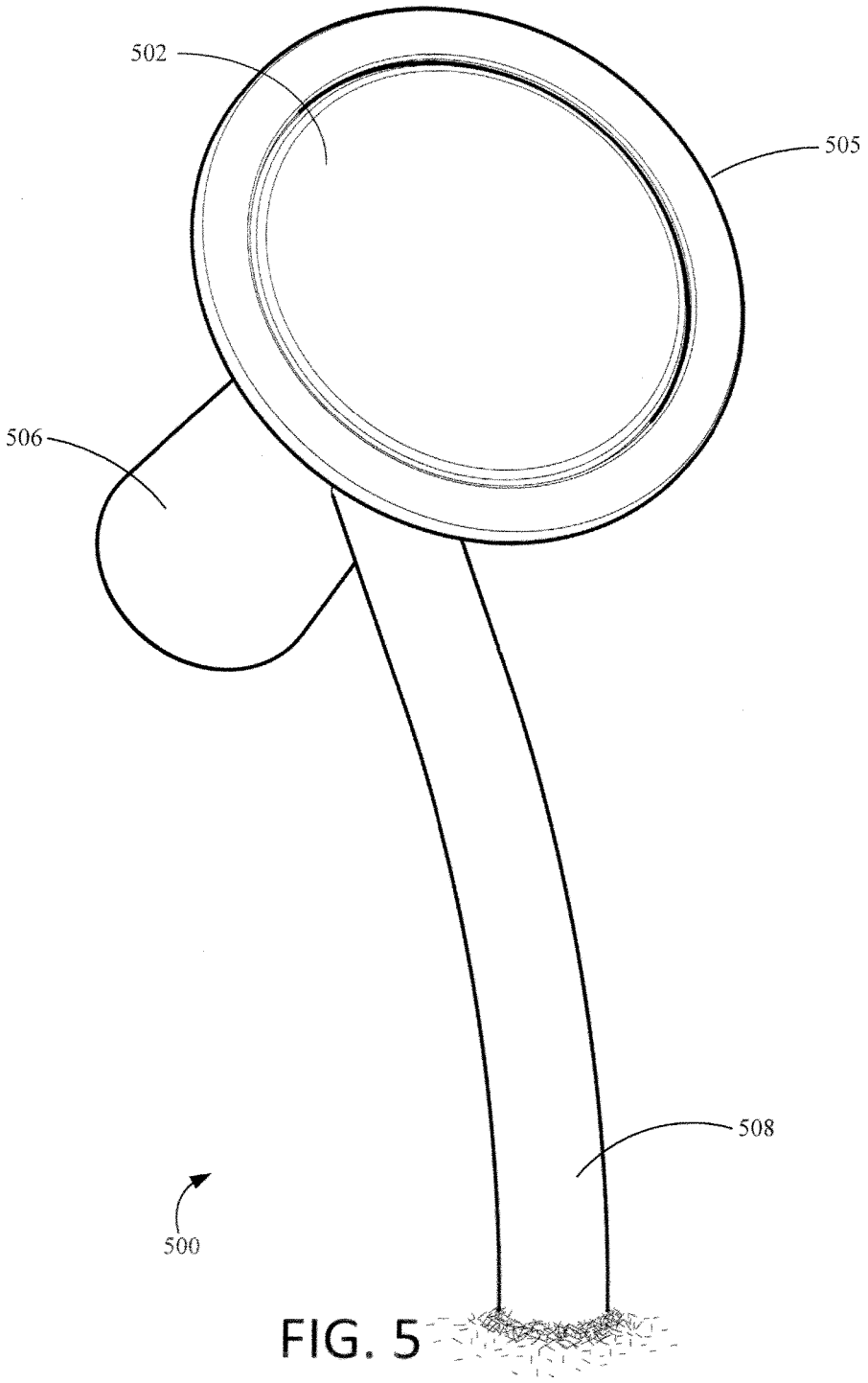
FIG. 5 illustrates an outdoor drum in accordance with one embodiment of the present invention.

FIG. 5 illustrates an outdoor drum in accordance with one embodiment of the present invention. Outdoor drum 500, in the embodiment illustrated in FIG. 5, comprises a base 508, a shell 506, a head 502 and a shield 505. Base 508 is permanently attached to a surface 510. In one embodiment, surface 510 is the ground. However, in other embodiments, base 508 could be mounted to another playground structure. In the embodiment of FIG. 5, base 508 comprises shell 506. In other embodiments, however, base 508 is attached to shell 506 through a fastening mechanism. Shell 506, as shown in FIG. 5, is an elongated cylinder which attaches to drum head 502. The shape of shell 506 can greatly influence the sound produced by drum 500. As such, the shape of shell 506 can be selected, in other embodiments, based on a desired sound and is not intended to be limited to the illustrated embodiments.

Drum head 502 is tensioned and coupled to shell 506. In one embodiment, head 502 is tensioned by stretching, and then coupling, to shell 506. In another embodiment, head 502 is pre-tensioned onto a ring, which is coupled to shell 506. In one embodiment, head 502 is greater than 12 inches wide. In one embodiment, head 502 is lesser than 24 inches wide. The edge of drum head 502 is protected by shield 505. Shield 505 may also, in one embodiment, provide tension to drum head 502. With different shapes of shell 506 can come many different problems, especially in an outdoor environment where precipitation and animal inhabitation are potential problems.

Figure 6:
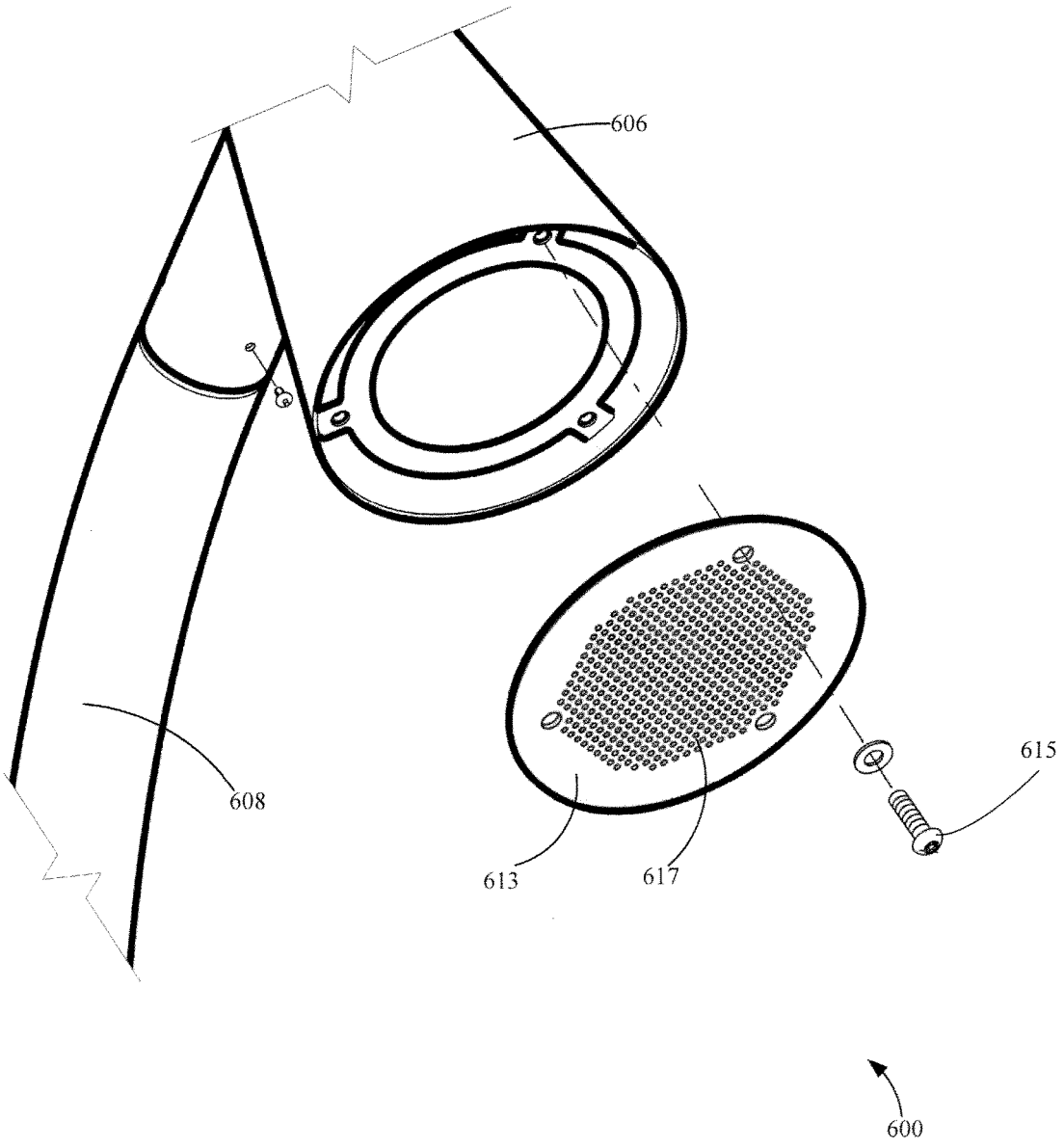
FIG. 6 illustrates a drain assembly for a drum in accordance with one embodiment of the present invention.

FIG. 6 illustrates a drain assembly for a drum in accordance with one embodiment of the present invention. In the embodiment shown in FIG. 6, drum assembly 600 comprises a drain 613, fasteners 615, shell 606, and base 608. One of the largest problems with adapting an instrument for outdoor use is the outdoor weather conditions such as rain and unintended animal inhabitation within sound reverberating spaces, accessible by a drain. Combatting these considerations requires a balance between draining precipitation, and not allowing animal inhabitation. One embodiment such as drum 600, fulfills both requirements by providing a drain 613.

Drain 613 is coupled to a bottom side of shell 606 through the use of one or more fasteners 615. In one embodiment, drain 613 is located on the bottom side of shell 606, utilizing the force of gravity to drain any potential precipitation enters shell 606. In one embodiment, drain 613 is a single small hole located in shell 606. In the embodiment of FIG. 6, drain 613 comprises a screen 617 that is attached to shell 606. In other embodiments, screen 617 could also be a mesh, filter, or other suitable configuration. A screen, such as screen 617 will allow water to drain, prevent animals from entering into shell 606 and also allow sound to escape shell 606. One consideration in the design of drain 613 is that the outdoor play equipment must be operable for long periods of time without maintenance. The holes located on drain 613 must be large enough to allow water to drain, but small enough to not allow animal inhabitation by, for example, wasps or other dangerous animals.

Figure 7:
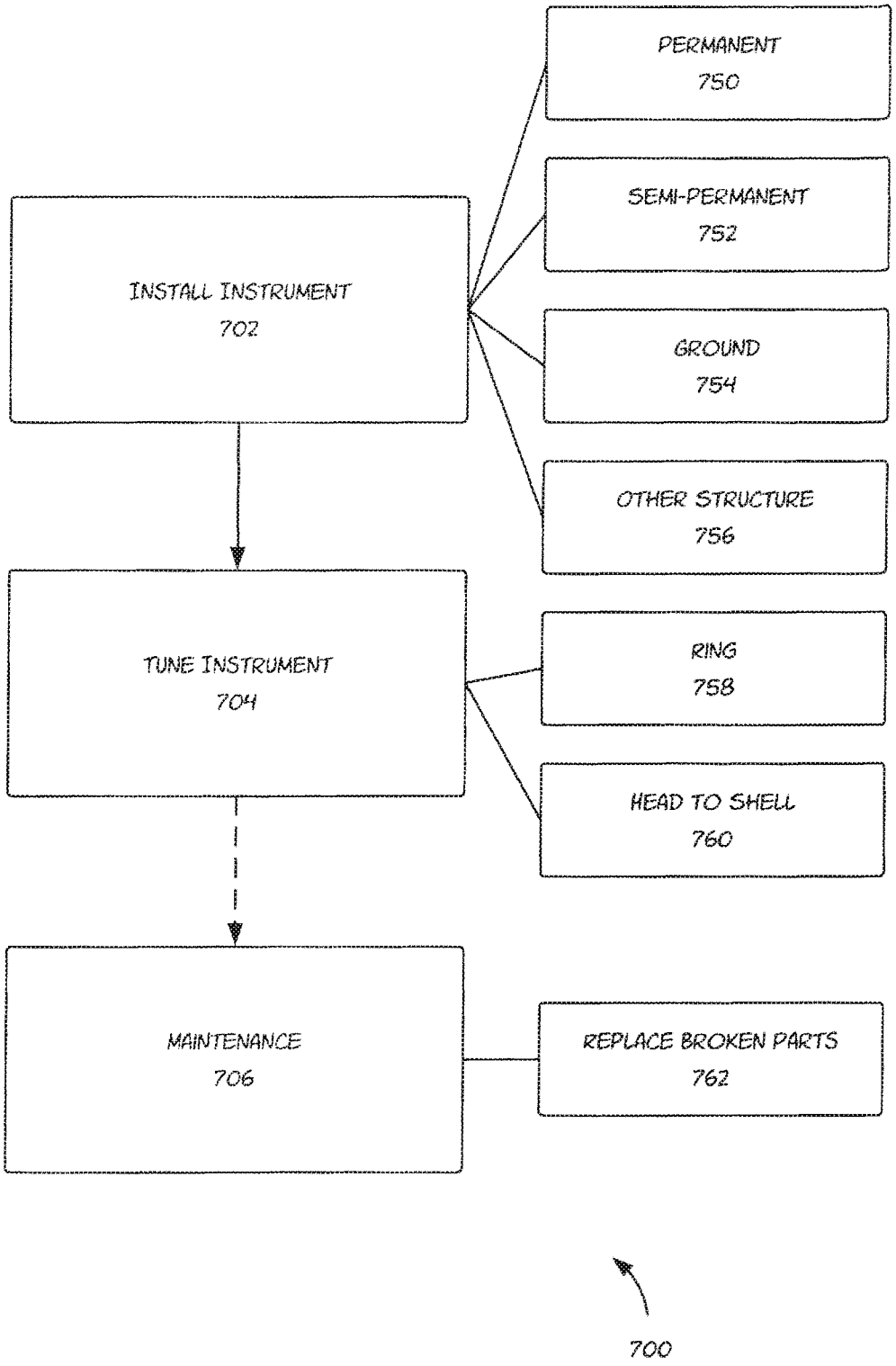
FIG. 7 illustrates a flow diagram of a method of permanently installing a drum in an outdoor environment in accordance with one embodiment of the present invention.

FIG. 7 illustrates a flow diagram of a method of permanently installing a drum in an outdoor environment in accordance with one embodiment of the present invention. Method 700 may be useful for permanently installing one or more drums in a recreational environment.

At block 702 the drum is installed. Unlike indoor instruments, outdoor instruments are installed substantially permanently, as indicated at block 750. Permanently, in one embodiment, is defined as contained within a playground and resistant to theft. In one embodiment, at block 702, the instrument is mostly assembled and permanently coupled to an attachment point at a playground. An attachment point at a playground would include another structure, as indicated at block, as indicated at block 756 or the ground, as indicated at block 754. In one embodiment, the drum is installed semi-permanently, as indicated at block 752.

At block 704 the drum is tuned. With regard to indoor instruments, tuning an instrument is generally done at the beginning of any practice or performance. With regard to an outdoor instrument, tuning must last much longer than that for an indoor instrument. In one embodiment, a drum configured for outdoor use may need to maintain an installed tuning configuration for an outdoor exposure period with substantially no maintenance. For example, a drum may need to maintain a tuning configuration for over 1 year, over 5 years, over 10 years, over 15 years or longer without tuning.

In one embodiment, a drum head comes pre-tuned on a ring, as indicated at block 758 and does not require any tuning; it would only require assembly. In another embodiment, the drum head is tuned on-site after installation in a head to shell configuration, as indicated at block 760. Because of the outdoor environment, the instrument must be tuned in such a way that outdoor conditions do not easily cause the drum to deviate from an installed tuning configuration. Therefore, in one embodiment, the drum head comprises a material that does not experience significant contraction or expansion with changes in ambient temperatures, which can change significantly from season to season.

At block 706 the drum is maintained. Block 706 is optional and may not always be performed. An example of maintenance would be replacing broken parts, as indicated at block 762. A desired characteristic of playground equipment is that it is substantially maintenance free. In one embodiment, the materials chosen and the design of the instruments in embodiments described herein achieve a low maintenance outdoor installed drum. In one embodiment, the drum maintains substantially the same sound after prolonged exposure to weather elements as it has at installation. However, in some embodiments, maintenance only concerns replacement of broken parts, as the drum maintains a tuned configuration without need for periodic retuning.

Figure 8:
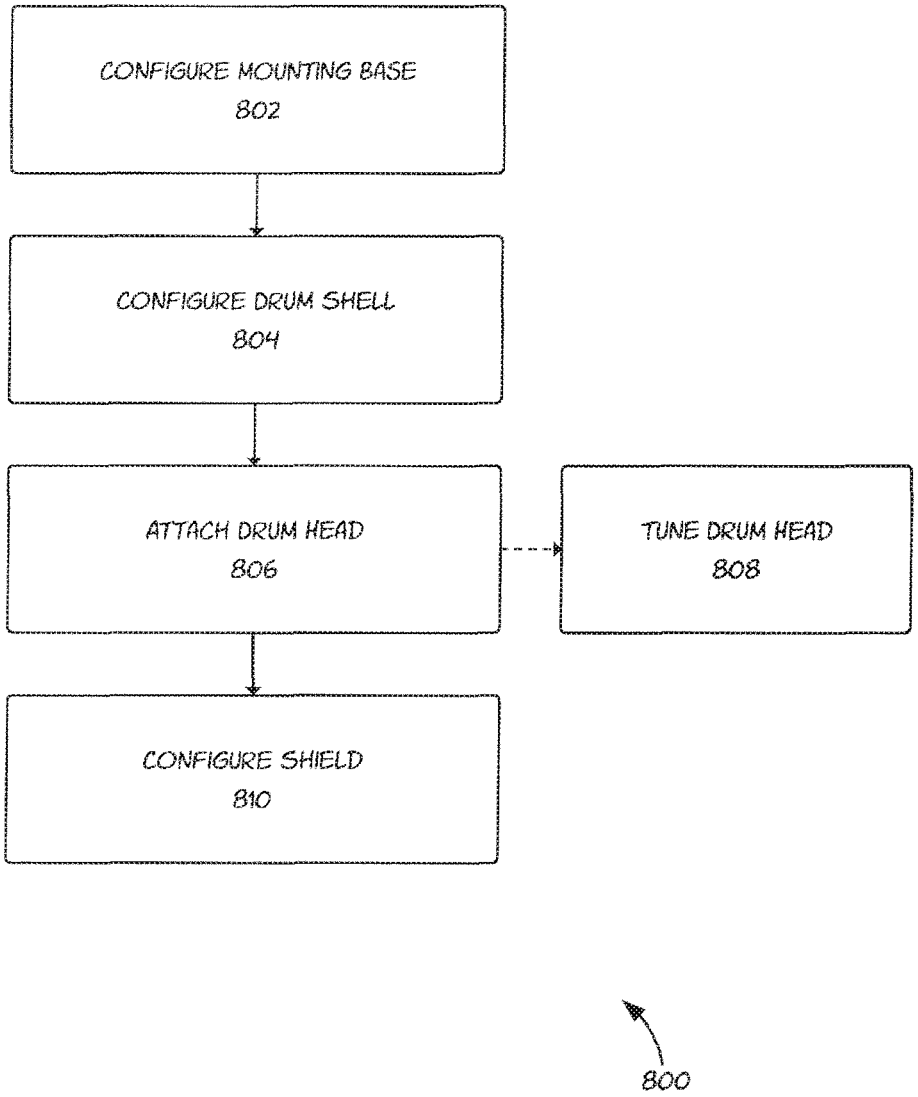
FIG. 8 illustrates a flow diagram of a method of installing a drum in accordance with one embodiment of the present invention.

FIG. 8 illustrates a flow diagram of a method of installing a drum in accordance with one embodiment of the present invention. Method 800 may be useful for permanently installing one or more drums in a recreational environment.

At block 802 the mounting base is configured. Configuring the mounting base may, in one embodiment, involve different steps depending on the type of mounting desired. In one embodiment, the mounting base may be the ground. In another embodiment, the mounting base may be another play structure. In another embodiment, the mounting base may be an exterior wall of a building, or other structure. In one embodiment, the base may be mounted into the ground through direct burial. In one embodiment, through a ground surface mount with the utilization of anchors and flanges. In one embodiment, if the mounting structure is another structure, the base may be coupled to the structure through the use of bolts or may be welded.

At block 804 the drum shell is configured. At block 804, the drum set shell is coupled to the base. In one embodiment, the drum shell is already attached to the base and blocks 802 and 804 are completed simultaneously. In one embodiment, the drum shell and base are oriented in such a way as to allow access to users who may be in a wheelchair.

At block 806 the drum head is attached. The drum head is attached to the drum shell. In one embodiment, the drum head is tensioned over the drum shell. In another embodiment, the drum head is attached to a rigid ring that tensions it and that rigid ring is attached to drum shell.

At block 808 the drum head is tuned. Tuning the drum head requires providing the correct tension across the drum head in order to achieve a desired sound when struck. In one embodiment, tuning the drum comprises applying tension to a drum head, for example by stretching the drum head into a tuned configuration. Once the appropriate tension is acquired, the drum head is locked into place and the tension is maintained. In one embodiment, the drum head is pre-tensioned onto a ring, which is then installed. In another embodiment, the drum head is tuned during installation.

At block 810 the shield is configured. In one embodiment, the shield is coupled to the drum shell and covers the edge of the drum head. In one embodiment, the shield merely protects the edge of the drum head. In another embodiment, the shield helps provide the tension across drum head and keep drum head in tune. In one embodiment, all of the fasteners and coupling mechanisms used to install the drum are theft resistant. In one embodiment, all of the fasteners are weather resistant.

Figure 9A:
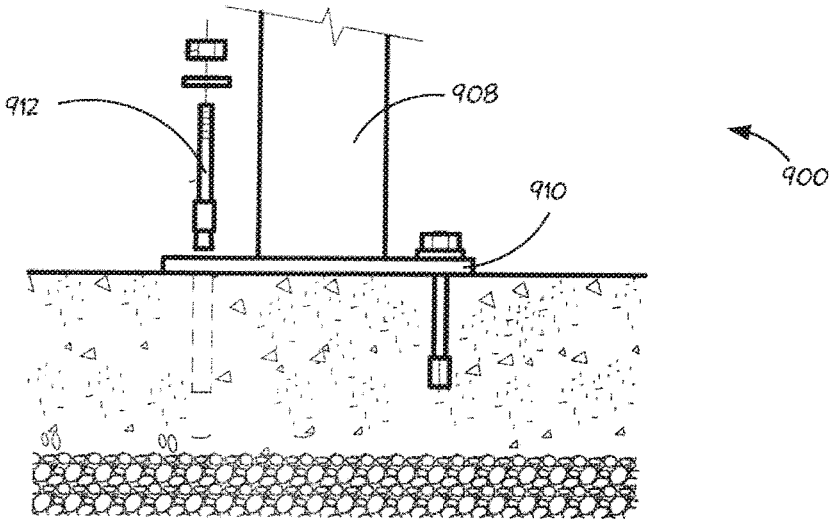
FIG. 9A and FIG. 9B illustrate cut away views of base mounting systems in accordance with some embodiments of the present invention.

FIG. 9A illustrates a base mounting system. Base mounting assembly 900, in one embodiment, comprises fastener 912, base 908 and flange 910. Mounting flange 910 extends out from base 908. Mounting flange 910 provides a flat surface on the button to contact the ground and apertures therethrough to allow fasteners 912 to pass through and anchor to the ground. In one embodiment, fasteners 912 are concrete wedge anchors. In another embodiment, fasteners 912 can be any device that could attach a flange to the ground.

Figure 9B:
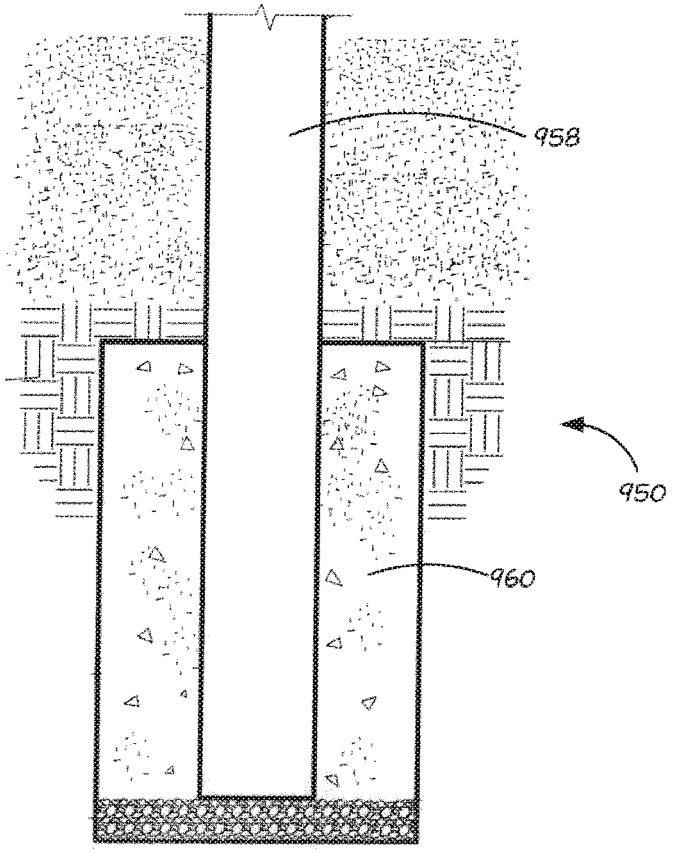

FIG. 9B illustrates a cutaway view of a mounting assembly. Base mounting assembly 950, in one embodiment, comprises a base 958 and a footing 960. Base 958 extends into the ground and into footing 960. Footing 960 may comprise concrete, in one embodiment. In another embodiment, footing 960 is just a solid piece of ground. Footing 960 may comprise any material so as long as base 958 is secured to the ground with minimal movement.

In one embodiment, once installed, for example using either of methods 700 or 800, a drum, for example any of the drums described herein, is configured to withstand significant force. Because of the risk of damage due to weather, and the risk of vandalism, installed outdoor drums may need to be much more durable than their indoor counterparts. For example, in one embodiment, a drum head is configured to withstand the force of a user kicking, or hitting it, without cracking. In one embodiment, a drum head is configured to withstand 3500 lbs over a 6"×6" portion of the surface without deforming or cracking. In one embodiment, the drum head is configured to withstand 4000 lbs over a 6"×6" portion of the surface without deforming or cracking. In one embodiment, a drum head is configured to withstand heat of up to 130° F. without cracking or deforming. In one embodiment, multiple compliance objectives are simultaneously satisfied—for example a drum head may withstand being kicked, or hit, while heated to 130° F. In one embodiment, a drum head is configured to withstand the force of an adult baseball bat swing without experiencing significant deformation or cracking. Such scenarios may be part of a compliance testing step, completed during installation, or pre-installation testing.

Although the present invention has been described with reference to preferred embodiments, workers skilled in the art will recognize that changes may be made in form and detail without departing from the spirit and scope of the invention.

What is claimed is:

1. A drum configured for permanent nstallation in an outdoor environment, the drum comprising:

a mounting structure configured to permanently engage a mounting surface in the outdoor environment;

a shell coupled to the mounting structure;

a drain coupled to the shell, wherein the drain is configured to allow a liquid to exit the shell, while inhibiting an animal entrance to the shell;

a drum head coupled to the shell through use of a plurality of fasteners, wherein the drum head comprises a tuning configuration; and wherein the drum is configured to be weather resistant, and wherein the drum head is configured to maintain the tuned configuration after a period of outdoor exposure.

2. The drum of claim 1, wherein the drum head comprises plastic.

3. The drum of claim 2, wherein the drum head comprises an ultraviolet (UV) stabilized polycarbonate.

4. The drum of claim 1, wherein the drain comprises a screen.

5. The drum of claim 1, wherein the period of outdoor exposure comprises the drum exposed to water.

6. The drum structure of claim 1, and further comprising a shield configured to cover the plurality of fasteners.

7. An outdoor musical drum for installation in an outdoor environment comprising:

a mounting location within the outdoor environment, wherein the outdoor musical instrument is installed substantially permanently at the mounting location;

a shell coupled to the mounting location, wherein the shell is configured to allow for sound reverberation;

a drum head coupled to the shell, wherein the drum head is tuned and configured to maintain a tuned configuration after an exposure period to the outdoor environment;

a shield configured to cover a coupling between the head and shell; and a drain located on the shell configured to drain an accumulated liquid out of the shell and wherein the drain is configured to inhibit an animal inhabitation.

8. The drum of claim 7, wherein the mounting location comprises a leg permanently coupled to a ground location.

9. The drum of claim 7, wherein the shell and shield comprise polycarbonate.

10. The drum of claim 9, wherein the head comprises a UV stabilized polycarbonate.

11. The drum of claim 7, wherein the drain comprises a screen.

12. The drum of claim 7, wherein the drum, once mounted at the mounting location, is substantially irremovable.

13. A method of installing a drum in a permanent outdoor location, the method comprising:

permanently coupling a mount to a ground location;

coupling a drum shell to the mount, wherein the coupling between the drum shell to the mount comprises a theft-resistant coupling;

coupling a drum head to the drum shell, wherein coupling the drum head to the drum shell comprises tensioning the drum head to a tuning configuration; and wherein the tuning configuration is maintained after an exposure period to weather elements in the permanent outdoor location.

14. The method of installing an outdoor drum of claim 13, and further comprises coupling a drain to the shell.

15. The method or installing an outdoor drum of claim 13, and further comprising coupling a shield to the shell, wherein the shield is configured to protect an edge of the drum head.

16. The method of installing an outdoor drum of claim 13, wherein coupling the head to the shell comprises, coupling a rigid ring to the shell, wherein the head is pre-stretched, to the tuning configuration, across the ring.

17. The method of installing an outdoor drum of claim 13, wherein the drum comprises a goblet drum.

18. The method of installing an outdoor drum of claim 13, wherein the drum comprises a kundu drum.

19. The method of installing an outdoor drum of claim 13, wherein the drum comprises a kettle drum.

* * * * *